United States Patent [19]

Reid et al.

[11] Patent Number: 5,007,132

[45] Date of Patent: Apr. 16, 1991

[54] HYDRAULIC DRIVE FOR PULL THROUGH DOCTOR BLADE TRANSFER SYSTEM

[75] Inventors: Robert A. Reid, Charlton City; Ronald F. Goodnow, Leicester, both of Mass.

[73] Assignee: Thermo-Electron Web Systems, Inc., Auburn, Mass.

[21] Appl. No.: 534,686

[22] Filed: Jun. 7, 1990

[51] Int. Cl.[5] ..... B08B 1/02

[52] U.S. Cl. ..... 15/256.53; 100/174; 162/281

[58] Field of Search ..... 15/256.53, 256.51, 256.5; 162/281; 100/174; 101/425

[56] References Cited

U.S. PATENT DOCUMENTS

| | | | |
|---|---|---|---|
| 2,664,792 | 1/1954 | Cook | 15/256.51 |
| 3,781,107 | 12/1973 | Ruhland | 15/256.53 X |
| 3,847,480 | 11/1974 | Fisher | 15/256.53 X |
| 4,528,067 | 7/1985 | Hedberg | 15/256.51 X |
| 4,691,406 | 9/1987 | Goodnow et al. | 15/256.53 |

FOREIGN PATENT DOCUMENTS

| | | | |
|---|---|---|---|
| 2474899 | 8/1981 | France | 15/256.53 |

*Primary Examiner*—Chris K. Moore

*Attorney, Agent, or Firm*—Samuels, Gauthier & Stevens

[57] ABSTRACT

In a pull through doctor blade transfer system wherein a coiled blade is payed off one rotatable reel while simultaneously being taken up on another rotatable reel, with an intermediate portion of the blade between the reels being supported in a blade holder arranged to apply the blade to a moving surface to be doctored, each reel is driven by a hydraulic motor. In operation, hydraulic fluid discharged from the motor driving the take up reel is fed to the motor connected to the pay off reel. This fluid is pumped to a high pressure by blade induced rotation of the pay off motor, thus creating a braking torque.

4 Claims, 2 Drawing Sheets

HYDRAULIC DRIVE FOR PULL THROUGH DOCTOR BLADE TRANSFER SYSTEM

BACKGROUND OF THE INVENTION

This invention relates to doctoring apparatus wherein flexible elongated doctor blades are advanced longitudinally across the surfaces being doctored.

U.S. Pat. No. 4,691,406, the disclosure of which is herein incorporated by reference in its entirety, discloses a doctoring apparatus of the above-mentioned type. The doctor blade has a length greater than the width of the surface being doctored. A blade holder applies an intermediate portion of the blade to the surface being doctored. The blade is movable longitudinally through the blade holder, and has continuing portions which extend in opposite directions beyond the ends of the holder to hydraulically driven pay off and take up reels. Hydraulically actuated clamps act on the continuing blade portions and are adjustable between closed settings preventing relative movement between them and the blade, and open settings permitting such relative movement. A hydraulic drive reciprocates the blade holder. The clamps are opened and closed in timed sequence with reciprocation of the blade holder to achieve longitudinal shifting of the blade in a selected direction across the doctored surface, from one to the other of the reels. This type of "pull through" blade transfer system maximizes efficiency by eliminating lost production time normally associated with the changing of conventional "cut to length" blades.

It is extremely vital to the optimum performance of the above-described pull through blade transfer system that the blade be kept under proper tension both on the pay off and take up runs between the reels and the clamps. Too little tension can result in uncontrolled expansion of the coils being removed from or accumulated on the reels, whereas excessive tension can have a damaging effect on the transfer equipment and/or the blade itself, in extreme cases causing blade breakage.

SUMMARY OF THE INVENTION

A general objective of the present invention is the provision of a pull through blade transfer system having the capability to closely control and maintain appropriate tension in the blade stock being payed off and taken up on the reels.

A more specific objective of the present invention is to provide a pull through blade transfer system wherein the hydraulic motors used to operate the reels are hydraulically interconnected in a manner permitting them to alternatively serve as drives or as dynamic brakes, depending on whether blade stock is being taken up on or payed off from their respective reels.

Other objects and advantages of the present invention will become more apparent as the description proceeds with reference to the accompanying drawings, wherein:

DETAILED DESCRIPTION OF ILLUSTRATED EMBODIMENT

Figure 1:
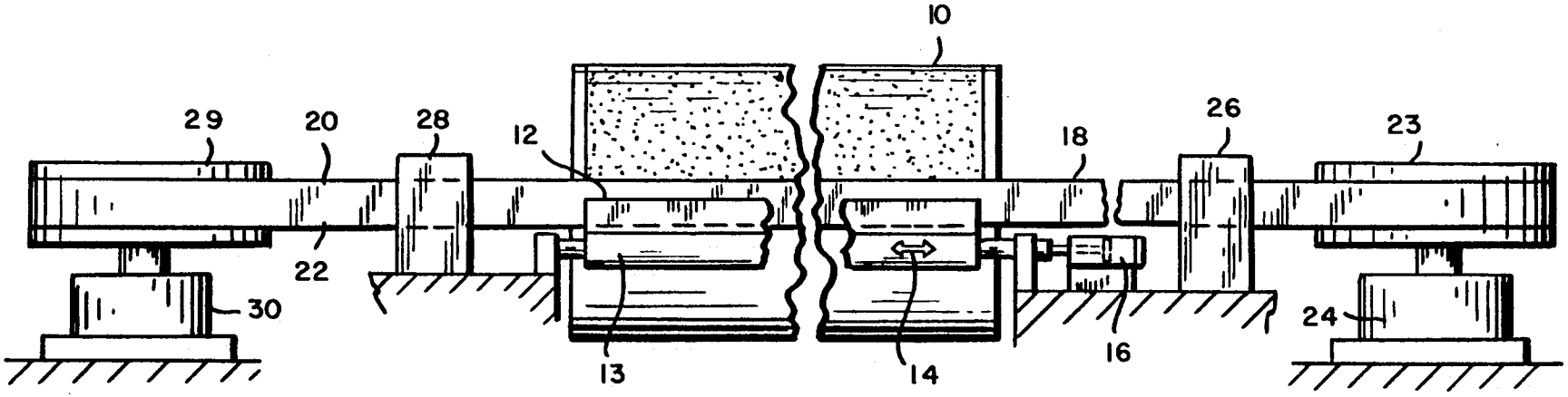
FIG. 1 is a schematic illustration of a pull through doctor blade transfer apparatus.

Referring initially to FIG. 1, a pull through doctor blade transfer apparatus is shown doctoring a rotating cylinder 10. A doctor blade holder 12 is mounted on a doctor back 13 and is positioned adjacent to the cylinder 10. The doctor back is adapted to be reciprocated to and fro in the direction of arrow 14 by a double acting piston-cylinder unit 16. The doctor back is rotatably adjusted by means of another pistoncylinder unit (not shown) to urge the holder 12 towards the cylinder 10, thus applying the working edge !8 of an elongated flexible doctor blade 20 to the roll surface. The doctor blade has a bottom edge 22 which is parallel to the working edge 18 and which is supported in the holder 12.

The doctor blade 20 is adapted to be wound into coil form. A cartridge 23 containing a fresh blade coil is mounted on a reel driven by a first hydraulic motor 24. The leading blade end is threaded through a first clamp 26, the blade holder 12, a second clamp 28, and is then connected to an empty cartridge 29 mounted on another reel driven by second hydraulic motor 30.

During the doctoring operation, the doctor back 13 and the holder 12 are reciprocated by the piston-cylinder unit 16, and one or the other of the clamps 26,28 is employed in timed sequence with this oscillation to shift the blade longitudinally across the cylinder surface, with blade stock being gradually paid off from the cartridge of one reel and taken up on the cartridge of the other reel. A more detailed description of this procedure is provided in the previously referenced U.S. Pat. No. 4,691,406.

When the trailing end of one blade length leaves a spent cartridge, that cartridge is replaced by another cartridge containing a fresh coil. The leading end of the fresh coil is then advanced to a position directly adjacent to the preceding trailing end, and the two ends are detachably interconnected. This having been accomplished, the doctoring operation is momentarily interrupted, the clamps are released, and the reels are speeded up to rapidly traverse the interconnected ends across the cylinder 10. Then, the doctoring operation is continued, and the blade ends are disconnected to allow the cartridge containing the spent coil to be replaced by an empty cartridge to which the fresh leading end is then connected.

Figure 2:
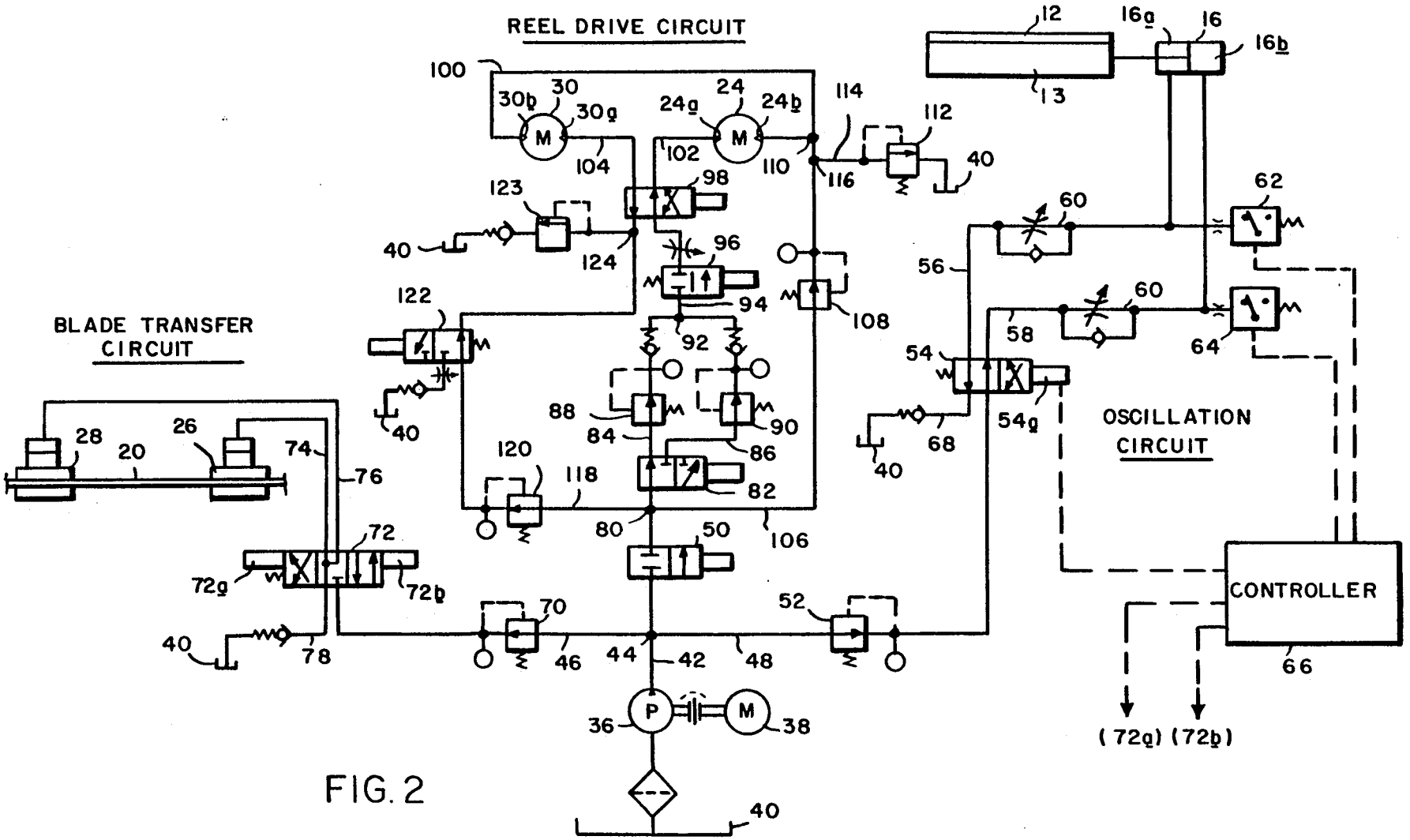
FIG. 2 is a schematic illustration of the hydraulic drive system in accordance with the present invention.

The hydraulic drive system used to operate the pull through apparatus of FIG. 1 will now be described with further reference to FIG. 2. A pump 36 driven by motor 38 withdraws hydraulic fluid from a reservoir 40 and discharges the same as a pressurized flow to line 42. Typically the pump discharge will be at an elevated pressure of about 2000 p.s.i. Line 42 communicates at junction 44 with lines 46,48, and continues on through a two-way solenoid valve 50. The continuing portion of line 42 feeds a "Reel Drive Circuit". Branch line 48 feeds an "Oscillation Circuit", and branch line 46 feeds a "Blade Transfer Circuit." The operation of each of these circuits will now be separately described in greater detail.

OSCILLATION CIRCUIT

Branch line 48 leads through a pressure reducing valve 52 and then to a four-way solenoid valve 54. Valve 52 drops the line pressure down to a lower level of for example 300–400 p.s.i. Valve 54 communicates with two lines 56,58 which each lead through flow control needle valves 60 before respectively communicating with the cylinder chambers **16,16*b* on opposite sides of the piston in piston-cylinder unit 16. Pressure switches 62,64** communicate respectively with lines 56,58 to sense pressure build up at each end of the piston stroke in unit 16. The signals from pressure switches 62,64 are fed to a controller 66 which in turn is connected to the solenoid 54*a* of valve 54.

In the illustrated setting of valve 54, hydraulic fluid is being fed to chamber 16*b* of piston-cylinder unit 16, causing the doctor back 13 to be moved to the left as viewed in the drawings. When pressure switch 64 senses a pressure build up indicating that the piston has reached the end of this stroke, a signal is fed to controller 66 which in turn signals the solenoid 54*a* of valve 54 to shift to its opposite setting. Hydraulic fluid is then fed to chamber 16*a*, causing the doctor back to shift in the opposite direction until pressure switch 62 senses a pressure build up, again signalling controller 66 and resulting in another reversal In this way, the doctor back is reciprocated to and fro, with exhaust fluid from the piston-cylinder unit being bled back through valve 54 and line 68 to the reservoir 40.

BLADE TRANSFER CIRCUIT

Branch line 46 leads through another pressure reducing valve 70 to a double ended solenoid valve 72. Valve 70 reduces line pressure to about 1500 p.s.i.. Lines 74,76 lead from valve 72 to the blade clamps 26,28, and another line 78 communicates with reservoir 40. The solenoids 72*a*,72*b* of valve 72 are controlled by controller 66 in response to signals received from the pressure switches 62,64. Thus, during a shifting of the blade stock from cartridge 23 to cartridge 29, when the doctor back 13 is being shifted to the left, both clamps 26,28 are open, and fluid is being bled from valve 72 via line 78 to the reservoir 40. At the end of the driving piston stroke of unit 16, as signalled by pressure switch 64, the controller 66 will energize the solenoid 72*b* of valve 72 to apply brake 28. When the doctor back 13 is shifted in the opposite direction, the blade will be prevented from moving with it, thus shifting the blade relative to the doctor back. At the next leftward stroke of the doctor back, the brake 28 will be released, thus allowing the frictional resistance between the blade and holder to pull the blade with the doctor back. In this way, the blade is incrementally shifted longitudinally across the cylinder 10 from cartridge 23 to cartridge 29. Blade shifting in the opposite direction, i.e., from cartridge 29 to cartridge 23, can be achieved in a similar manner by allowing brake 28 to remain open and by employing brake 26 in timed sequence with doctor back shifting, again in response to signals from the controller 66.

REEL DRIVE CIRCUIT

Line 42 continues from junction 44 through two-way solenoid valve 50, and through junction 80 to a four-way solenoid valve 82. Lines 84,86 respectively lead from valve 82 through pressure reducing valves 88,90 before being rejoined at junction 92 and continuing as a common line 94 through two-way solenoid valve 96 to a four-way solenoid valve 98.

The hydraulic motors 24,30 are each respectively provided with high pressure ports 24*a*,30*a* and low pressure ports 24*b*,30*b*. The low pressure ports 24*b*,30*b* are interconnected by a low pressure line 100. Lines 102,104 respectively connect high pressure ports 24*a*,30*a* to valve 98.

Pressure reducing valve 88 serves to reduce line pressure to about 400 p.s.i., whereas pressure reducing valve 90 reduces line pressure to about 1400 p.s.i..

Line 106 branches from junction 80 through a pressure reducing valve 108 before joining low pressure connecting line 100 at junction 110. Valve 108 reduces line pressure to about 200 p.s.i. and insures that an appropriate back pressure is applied to both motors 24,30 in order to avoid cavitation. A relief valve 112 is connected by line 114 to line 106 at junction 116.

Another line 118 branches from junction 80 through a pressure reducing valve 120 and through a three-way solenoid valve 122 to valve 98. Valve 122 also communicates with reservoir 40. A pressure relief valve 123 communicates with reservoir 40 and with line 118 at junction 124.

The Reel Drive Circuit may be operated in any one of the following modes:

a. Blade Tensioning

In this operational mode, the reel drive circuit operates in conjunction with the Blade Transfer Circuit and the Oscillation Circuit to insure that appropriate tension is maintained in the blade stock as it is uncoiled from one reel and coiled onto the other reel. Valve 50 is adjusted to direct fluid through junction 80 to valve 82. Valve 82 is adjusted to direct fluid through pressure reducing valve 88, thereby feeding fluid at a reduced pressure of approximately 400 p.s.i. to valve 96. Valve 96 is adjusted to direct fluid to valve 98 which in turn is adjusted to direct fluid to the motor operating in a "drive" mode to take up blade stock being received from the reciprocating doctor back 13. In the condition illustrated in FIG. 2, motor 24 is being operated in the "drive" mode to take up blade stock being shifted in the right hand direction as viewed in FIG. 1. The discharge fluid from motor 24 is exhausted through low pressure port 24*b* and fed via line 100 to the low pressure port 30*b* of motor 30, the latter being in a "pay off" mode. As the blade stock is payed off from reel 29 by the reciprocation of doctor back 13 acting in conjunction with brake 26, the motor 30 is rotated in a direction opposite to its drive direction, thereby pumping the fluid received from motor 24 via line 100. This pumping action is opposed by the pressure of the fluid in line 104, in this case approximately 400 p.s.i. Thus, motor 30, when in this pumping mode, operates as a dynamic brake to maintain an appropriate level of tension in the blade stock being payed off from cartridge 29.

When blade stock is being advanced in the opposite direction, i.e., from cartridge 23 to cartridge 29, valve 98 is shifted to its opposite setting, thereby causing motor 30 to operate in the drive mode while motor 24 operates in the pumping or dynamic brake mode.

b. Rapid Traverse

Situations will arise where it becomes necessary to interrupt the doctoring operation while blade stock is rapidly traversed from one reel to the other. This might be required, for example, when traversing the detachably interconnected ends of spent and fresh coils. Under these circumstances, valve 72 is adjusted to dump fluid back to the reservoir 40, thereby allowing both clamps 26,28 to remain open. Also, valve 54 is adjusted to dump fluid back to reservoir 40, thereby interrupting reciprocation of the doctor back 13. Under these conditions, valve 82 is adjusted to direct fluid through pressure reducing valve 90 in order to feed higher pressure fluid through valves 96 and 98 to the motor operating in the drive mode. The higher fluid pressure will result in a higher volume of fluid being fed to the motor, which in turn will produce a more rapid blade traverse.

c. Initial Threading

Under certain conditions, when threading the front end of a fresh coil through the apparatus, or when locating the front end of a fresh coil next to the trailing end of a spent coil in preparation for connecting the two together, it will be necessary to slowly drive one reel while allowing the other reel to remain stationary. Assume for example that one wishes to pay off blade stock from the reel driven by motor 30 while allowing the reel driven by motor 24 to remain stationary. Valve 96 is adjusted to block flow to valve 98. This allow fluid to flow from junction 80 through pressure reducing valve 108 and then on through low pressure line 100 to low pressure port 39*b*. This will produce reverse rotation of motor 30 with a resulting pay off of blade stock. Exhaust fluid will continue through port 30*a*, line 104 and energized solenoid valve 122 back to reservoir 40. Motor 24 will remain stationary because through flow is blocked by the closure of valve 96.

Reverse rotation of motor 24 with motor 30 remaining stationary can be achieved by simply shifting valve 98 to its opposite setting.

In light of the foregoing, it will now be appreciated by those skilled in the art that the hydraulic drive system of the present invention is extremely versatile, allowing easy selection of various operational modes in response to various needs of the doctoring operation. The motors 24,30 can act as drives, or alternately they can serve as effective dynamic brakes.

We claim:

1. For use in a doctoring apparatus wherein a coiled elongated doctor blade is payed off one rotatable reel while simultaneously being taken upon another rotatable reel, with an intermediate portion of the blade extending between said reels being supported by a blade holder arranged to apply said blade to a moving surface toe doctored, a hydraulic drive system for longitudinally shifting said blade across said surface and through said blade holder from one to the other of said reels, said system comprising:

first and second hydraulic motors, each motor being drivingly connected to one of said reels, said motors being of the type which are powered by a pressurized flow of hydraulic fluid admitted thereto via a high pressure port and discharged therefrom via a low pressure port;

a reservoir containing a supply of hydraulic fluid;

pump means for withdrawing hydraulic fluid from said reservoir and for discharging a pressurized flow of said fluid;

low pressure conduit means communicating with the low pressure ports of said hydraulic motors to provide a fluid connection therebetween;

high pressure conduit means communicating with said reservoir, said pump means, and the high pressure ports of said hydraulic motors; and control value means associated with said high pressure conduit means, said control valve means being adjustable between a first setting at which said pump means is connected to the high pressure port of said first hydraulic motor and the high pressure port of said second hydraulic motor is connected to said reservoir, and a second setting at which said pump means is connected to the high pressure port of said second hydraulic motor and the high pressure port of said first hydraulic motor is connected to said reservoir;

whereupon when said control valve means is adjusted to said first setting, said first reel is driven to take up said doctor blade thereon, with the doctor blade being simultaneously payed off said second reel, causing said second motor to pump the low pressure fluid discharge received from said first motor via said low pressure conduit means back to said reservoir, and when said control valve means is adjusted to said second setting, said second reel is driven to take up said doctor blade thereon, with said doctor blade being payed off said first reel and causing said first motor to pump the low pressure fluid discharge received from said second motor via said low pressure conduit means back to said reservoir.

2. The hydraulic drive system of claim 1 wherein said doctor back is reciprocated in the direction of blade shifting across said surface, said reciprocation being imparted by means of a double acting hydraulic piston-cylinder unit connected to said high pressure conduit means by first branch conduit means, said piston-cylinder unit being powered by hydraulic fluid received from said pump means via first and second feed lines connected thereto.

3. The hydraulic drive system of claim 2 wherein operation of said double acting hydraulic piston-cylinder unit is controlled by a controller responsive to pressure increases in said first and second feed lines.

4. The hydraulic drive system of claim 3 wherein said doctor blade is acted upon by at least one hydraulically actuated clamp arranged between one of said motors and said doctor back, said clamp being connected to said high pressure conduit means by second branch conduit means, said clamp being powered by hydraulic fluid received from said pump means and being controlled by said controller in response to pressure increases in said first and second feed lines.

* * * * *